US007556079B2

(12) United States Patent
Hicks et al.

(10) Patent No.: US 7,556,079 B2
(45) Date of Patent: Jul. 7, 2009

(54) AWNING ASSEMBLY

(75) Inventors: Michael Hicks, El Paso, TX (US); Brandon Moore, Edgewood, NM (US)

(73) Assignee: Dometic, LLC, Elkhart, IN (US)

( * ) Notice: Subject to any disclaimer, the term of this patent is extended or adjusted under 35 U.S.C. 154(b) by 0 days.

(21) Appl. No.: 11/759,412

(22) Filed: Jun. 7, 2007

(65) Prior Publication Data

US 2008/0142167 A1 Jun. 19, 2008

Related U.S. Application Data

(62) Division of application No. 10/919,041, filed on Aug. 16, 2004, now Pat. No. 7,281,560.

(51) Int. Cl.
*E04F 10/06* (2006.01)

(52) U.S. Cl. ..... 160/160; 67/304.1

(58) Field of Classification Search ..... 160/300, 160/301, 304.1, 305, 291, 315, 67, 66, 323.1, 160/24; 242/385.4, 385
See application file for complete search history.

(56) References Cited

U.S. PATENT DOCUMENTS 1,228,668 A 6/1917 Hanauer
1,726,589 A * 9/1929 Schultes ..... 160/315
2,696,249 A * 12/1954 Prokop et al. ..... 160/24
2,822,040 A * 2/1958 Petrick et al. ..... 160/24
3,955,611 A * 5/1976 Coles et al. ..... 160/67
4,160,458 A 7/1979 Marcellus et al.
4,164,972 A 8/1979 Bennett
4,705,148 A * 11/1987 Zindler ..... 192/223
4,719,954 A 1/1988 Curtiss et al.
4,759,396 A 7/1988 Quinn
5,174,352 A 12/1992 Murray et al.
5,924,465 A 7/1999 Malott
6,000,501 A 12/1999 Evans
6,021,834 A 2/2000 Malott
6,276,424 B1 8/2001 Frey, Jr.

* cited by examiner

*Primary Examiner*—Blair M. Johnson
(74) *Attorney, Agent, or Firm*—Pearne & Gordon LLP

(57) ABSTRACT

An awning assembly includes an awning and support arms and rafters that are adapted to support the awning from a backing structure both when the awning is in an extended position and when it is in a retracted position. The support arms and rafters are mounted to the backing structure in a manner that allows for the positions of the support arms and rafters to be readily converted as the awning is extended and retracted. Additionally, the manner in which each rafter is joined to a respective support arm allows for the convenient rearrangement of the rafters and support arms to facilitate supporting of the awning in both the extended and retracted positions. A cooperative awning assembly, on which the awning is wound and unwound, and locking device are provided to lock the awning in place. The awning assembly, in a particular embodiment, is applied to a pop-up trailer.

15 Claims, 7 Drawing Sheets

AWNING ASSEMBLY

BACKGROUND OF THE INVENTION

The present invention relates, generally, to awning assemblies and, in particular, to awning assemblies for recreational vehicles such as, so-called, pop-up trailers.

A variety of awning assemblies are available for the purpose of providing an awning for creating a sheltered area. Typically, such awning assemblies include an awning, or canopy, and support arms and rafters for supporting the awning. The awning, normally, includes a rearward border, or edge, that is anchored to a backing structure such as a wall; a forward border, or edge; and a main awning section that joins the forward and rearward borders of the awning. When the awning is stored and not in use, the forward border of the awning is maintained in a retracted position adjacent the backing structure. Alternatively, when the awning is in use, the forward border of the awning is in an extended position away from the backing structure. The awning is supported in its extended position by the support arms which are joined to the forward border of the awning and by the rafters which, in addition to supporting the awning, apply tension to the awning so as to make it taut. Usually, the support arms and the rafters are mounted to and supported from the backing structure, although the support arms, at least, may be supported from the ground.

In order to facilitate the extension and retraction of the awning from and to the backing structure, the forward border of the awning can be attached to a roller mechanism from which the awning is unwound when it is extended and on which the awning is wound when it is retracted. The roller mechanism can include a torsion spring arranged so that the awning is moved to its extended position against the tension of the spring. Conversely, the torsion spring will assist in the winding of the awning on the roller mechanism when the awning is returned from its extended position to its retracted position adjacent the backing structure. As an aid for maintaining the awning in the extended position against the tension of the torsion spring, a mechanism for locking the roller mechanism in place can be provided.

Awning assemblies, as described, are often applied to recreational vehicles such as, for example, travel trailers and mobile homes. In these instances, the backing structure comprises a vehicle surface and it is often necessary to incorporate unique design features into the awning assembly in such cases to accommodate the diversity of shapes and configurations that such vehicle surfaces often take. In this regard, the design of an awning assembly for a pop-up trailer presents special challenges. Pop-up trailers, of course, include a collapsible tent-like top that is lowered for traveling or storage and raised when the trailer is in use. Consequently, the design of an awning assembly in such a case must accommodate the changed configuration of the pop-up trailer as its tent-like top is alternately raised and lowered.

SUMMARY OF THE INVENTION

The present invention provides an awning assembly that incorporates several desirable features. These features include the manner in which the support arms and rafters are mounted to both the awning and the backing structure when the awning is in a retracted position, on the one hand, and when the awning is in an extended position, on the other hand. The mounting features allow for the positions of the support arms and rafters, in relation to the awning and backing structure, to be readily converted as the awning is moved between its retracted and extended positions. Additionally, the manner in which each rafter is joined to a respective support arm allows for the convenient rearrangement of the rafters and support arms in relation to one another when the awning is moved between its retracted and extended positions. Further, a cooperative roller mechanism, on which the awning is wound and unwound, and locking device are provided to lock the awning in place such as when it is in an extended position. Moreover, the foregoing features are incorporated into an awning assembly that can be applied to a pop-up trailer.

Thus, according to one aspect, the awning assembly includes a substantially continuous awning having a forward border with first and second opposed end portions, a rearward border and a main awning section joining the forward and rearward borders of the awning. The forward border of the awning is extendable from a retracted position to an extended position and retractable from the extended position to the retracted position. The awning assembly also includes first and second support arms. The first support arm, the length of which is adjustable, has first and second opposed end portions with the first opposed end portion of the first support arm and the first opposed end portion of the forward border of the awning being joined for concurrent movement when the awning is retracted and extended. The second support arm, the length of which is also adjustable, has first and second opposed end portions with the first opposed end portion of the second support arm and the second opposed end portion of the forward border of the awning being joined for concurrent movement when the awning is retracted and extended. Also included in the awning assembly are first and second rafters. The first rafter, the length of which is adjustable, has first and second opposed end portions with the first opposed end portion of the first rafter being joined with the first opposed end portion of the first support arm for pivotal movement of the first rafter in relation to the first support arm and for rotational movement of the first rafter about the first support arm. The second rafter, the length of which is also adjustable, has first and second opposed end portions with the first opposed end portion of the second rafter being joined with the first opposed end portion of the second support arm for pivotal movement of the second rafter in relation to the second support arm and for rotational movement of the second rafter about the second support arm.

According to another aspect, the awning assembly includes a first mounting plate to which the second opposed end portion of the first support arm and the second opposed end portion of the first rafter are attached when the awning is in a retracted position. The awning assembly also includes a second mounting plate to which the second opposed end portion of the second support arm and the second opposed end portion of the second rafter are attached when the awning is in a retracted position. In a particular aspect, the second opposed end portion of the first support arm is pivotally secured to the first mounting plate and the second opposed end portion of the second support arm is pivotally secured to the second mounting plate. Additionally, the second opposed end portion of the first rafter is releasably secured to the first mounting plate by means of a releasable securing element on the second opposed end portion of the first rafter and the second opposed end portion of the second rafter is releasably secured to the second mounting plate by means of a releasable securing element on the second opposed end portion of the second rafter. In yet another particular aspect, the first opposed end portion of the first support arm includes a releasable securing element that is substantially identical to a releasable securing element on the second opposed end portion of the first rafter and the first opposed end portion of the second support arm includes a releasable securing element that is substantially identical to a releasable securing element on the second opposed end portion of the second rafter.

According to a more detailed aspect, an awning assembly is provided that is adapted to be mounted to a backing structure and the rearward border of the awning is adapted to be anchored to the backing structure. Correspondingly, the forward border of the awning is extendable from a retracted position adjacent the backing structure to an extended position away from the backing structure and retractable from the extended position to the retracted position. The assembly includes a first support arm that has first and second opposed end portions with the first opposed end portion of the first support arm and the first opposed end portion of the forward border of the awning being joined for concurrent movement when the awning is extended and retracted. The second opposed end portion of the first support arm is adapted to be pivotally connected to the backing structure for pivotal movement away from the structure for extension of the awning and toward the structure for retraction of the awning. The first support arm has at its first opposed end portion an element adapted to releasably secure the first support arm to a first mating element on the backing structure when the awning is in a retracted position. The awning assembly also includes a second support arm that has first and second opposed end portions with the first opposed end portion of the second support arm and the second opposed end portion of the forward border of the awning being joined for concurrent movement when the awning is extended and retracted. The second opposed end portion of the second support arm is adapted to be pivotally connected to the backing structure for pivotal movement of the second support arm away from the structure for extension of the awning and toward the structure for retraction of the awning. The second support arm has on its first opposed end portion an element adapted to releasably secure the second support arm to a second mating element on the backing structure when the awning is in the retracted position. Also included in the awning assembly is a first rafter that has first and second opposed end portions with the first opposed end portion of the first rafter being joined with the first opposed end portion of the first support arm for pivotal movement of the first rafter in relation to the first support arm, and the second opposed end portion of the first rafter having an element adapted to releasably secure the first rafter to a third mating element on the backing structure when the awning is in the retracted position and releasably secure the first rafter to the first mating element when the awning is in the extended position. A second rafter is also included in the awning assembly and has first and second opposed end portions. The first opposed end portion of the second rafter is joined with the first opposed end portion of the second support arm for pivotal movement of the second rafter in relation to the second support arm, and the second opposed end portion of the second rafter has an element adapted to releasably secure the second rafter to a fourth mating element on the structure when the awning is in the retracted position and releasably secure the second rafter to the second mating element when the awning is in the extended position. In a particular aspect, the lengths of the support arms and the lengths of the rafters are adjustable and in a specific embodiment are made of telescoping members. In yet another particular aspect, each of the mating elements comprise female mating elements and each of the elements on the support arms and rafters comprise male elements. The male elements on the first opposed end portion of the first support arm and the second opposed end portion of the first rafter are, substantially, identical and the male elements on the first opposed end portion of the second support arm and the second opposed end portion of the second rafter are, substantially, identical. In still another particulate aspect, the female mating elements comprise spherical sockets and the male elements comprise spherical balls.

According to yet another aspect, in the awning assemblies described above, the first opposed end portion of the first rafter is joined with the first opposed end portion of the first support arm by a first bracket and the first opposed end portion of the second rafter is joined with the first opposed end portion of the second support arm by a second bracket. The first opposed end portion of the first rafter is pivotally joined to the first bracket and the first bracket is rotatably secured to the first support arm whereby the first rafter may be rotated about the first support arm. The first opposed end portion of the second rafter is pivotally joined to the second bracket and the second bracket is rotatably secured to the second support arm whereby the second rafter may be rotated about the second support arm. The first bracket is rotatably secured to the first support arm so that the first rafter may be rotated about the first support arm in connection with the securing of the second opposed end portion of the first rafter to the first mating element on the backing structure and the second bracket is rotatably secured to the second support arm so that the second rafter may be rotated about the second support arm in connection with the securing of the second opposed end portion of the second rafter to the second mating element on the structure.

According to a further aspect, a roller mechanism about which a flexible material, such as an awning in the described awning assemblies, may be wound and unwound includes a roller tube and a locking device. The roller tube has two opposed end portions and a longitudinal axis of rotation that extends from one opposed end portion of the roller tube to the other opposed end portion through the center of the roller tube. The roller tube is mounted for rotation in both a clockwise and a counterclockwise direction about the longitudinal axis of rotation and is adapted to be attached to one end of the flexible material. At least one opposed end portion of the roller tube has at least one longitudinal slot extending substantially parallel to the longitudinal axis of rotation of the roller tube. The locking device is mounted adjacent the at least one opposed end portion of the roller tube for selective movement axially of the longitudinal axis of rotation of the roller tube toward and away from the at least one opposed end portion of the roller tube having at least one longitudinal slot and for nonrotational movement about the longitudinal axis of rotation of the roller tube. The locking device includes a locking pin for insertion into the at least one longitudinal slot when the locking device is moved into engagement with the at least one opposed end portion of the roller tube having at least one longitudinal slot and for removal from the at least one longitudinal slot when the locking device is moved out of engagement with the at least one opposed end portion of the roller tube having at least one longitudinal slot. In a particular aspect, a rod is provided that extends along the longitudinal axis of rotation of the roller tube, the rod being secured against rotational movement. A resilient element is connected to the rod and the roller tube so as to resist rotation of the roller tube about the longitudinal axis of rotation in relation to the rod. In an additional particular aspect, the rod extends outwardly of the at least one opposed end portion of the roller tube that has at least one longitudinal slot, and the locking device is mounted on the rod for selective movement axially toward and away from the at least one opposed end portion of the roller tube having at least one longitudinal slot and for selective nonrotational movement with respect to the rod.

According to a further particular aspect, the at least one opposed end portion of the roller tube that has at least one longitudinal slot includes a closure cap through which the rod extends outwardly of the roller tube, the roller tube being mounted for rotational movement on the rod by means of the closure cap, and the at least one longitudinal slot being located in the closure cap. According to still another particulate aspect, the resilient element comprises a torsion spring through which the rod extends. In accordance with a further particulate aspect, the at least one closure cap includes two diametrically opposed longitudinal slots and the locking device includes two locking pins that are positioned on the locking device so that they may be inserted into the two diametrically opposed slots in the closure cap when the locking device is moved into engagement with the roller tube. According to yet another particulate aspect, each opposed end portion of the roller tube is provided with a respective closure cap having two diametrically opposed slots, and a respective locking device is provided adjacent each of the opposed end portions of the roller tube. Each locking device includes two locking pins that are positioned on the locking device so that they may be inserted into the two diametrically opposed slots in a respective adjacent closure cap.

According to still another aspect, a roller mechanism is incorporated into the awning assemblies described above so that the forward border of the awning is attached to the roller mechanism. In such an instance, the awning is unwound and wound as the awning is extended and retracted, respectively. In accordance with a particular aspect in this regard, the roller mechanism includes a roller tube to which the forward border of the awning is attached and from which the awning is unwound and on which the awning is wound as the awning is extended and retracted, respectively. The roller tube has two opposed end portions and a longitudinal axis of rotation extending from one opposed end portion to the other opposed end portion through the center of the roller tube. A rod extends along the longitudinal axis of rotation of the roller tube and has two opposed end portions that extend beyond the respective end portions of the roller tube, the opposed end portions of the rod being fixed to respective first opposed end portions of the first support arm and the second support arm of the awning assembly. A torsion spring is fastened to the roller tube and to the rod so that the torsion spring resists the rotation of the roller tube in a direction for unwinding of the awning from the roller tube and the extension of the awning from the retracted position to the extended position and assists the rotation of the roller tube in a direction for winding of the awning on the roller tube and the retraction of the awning from the extended position to the retracted position. A locking arrangement is included for releasably locking the roller tube to the rod.

According to yet another aspect, the awning assemblies described above are mounted to pop-up, or tent, trailers that have an upper section and a lower section, the upper section being movable between a raised position and a lowered position in relation to the lower section. In that instance, the rearward border of the awning is anchored to the upper section of the tent trailer, the second opposed end portions of the first and second support arms are pivotally connected to the lower section of the tent trailer for pivotal movement of the support arms away from the tent trailer for extension of the awning and toward the tent trailer for retraction of the awning, the first and second mating elements are located on the upper section of the tent trailer and the third and fourth mating elements are located on the lower section of the tent trailer and the third and forth mating elements are located on the lower section of the tent trailer.

BRIEF DESCRIPTION OF THE DRAWINGS

The foregoing and other features of the present invention will be apparent from the description below with reference to the drawings wherein.

DETAILED DESCRIPTION OF THE INVENTION

The following description of the awning assembly of the invention is presented with reference to a, so-called, pop-up, or tent, trailer. However, the awning assembly may be used with any type of trailer and, indeed, can be applied to a variety of structures, such as, for example, the side of a building.

Figure 1:
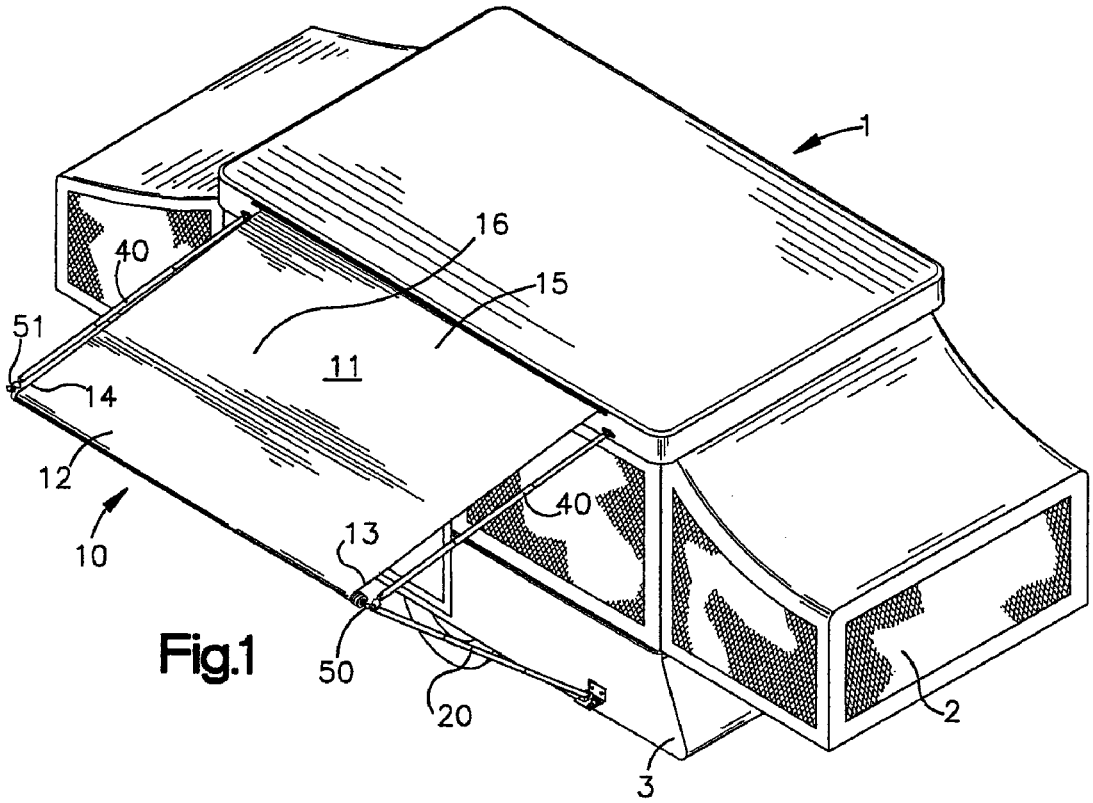
FIG. 1 is a perspective view of a pop-up trailer with the tent-like upper section of the trailer shown in a raised position and the awning assembly of the invention mounted to the trailer with the awning shown in an extended position to create a sheltered area.
Figure 1A:
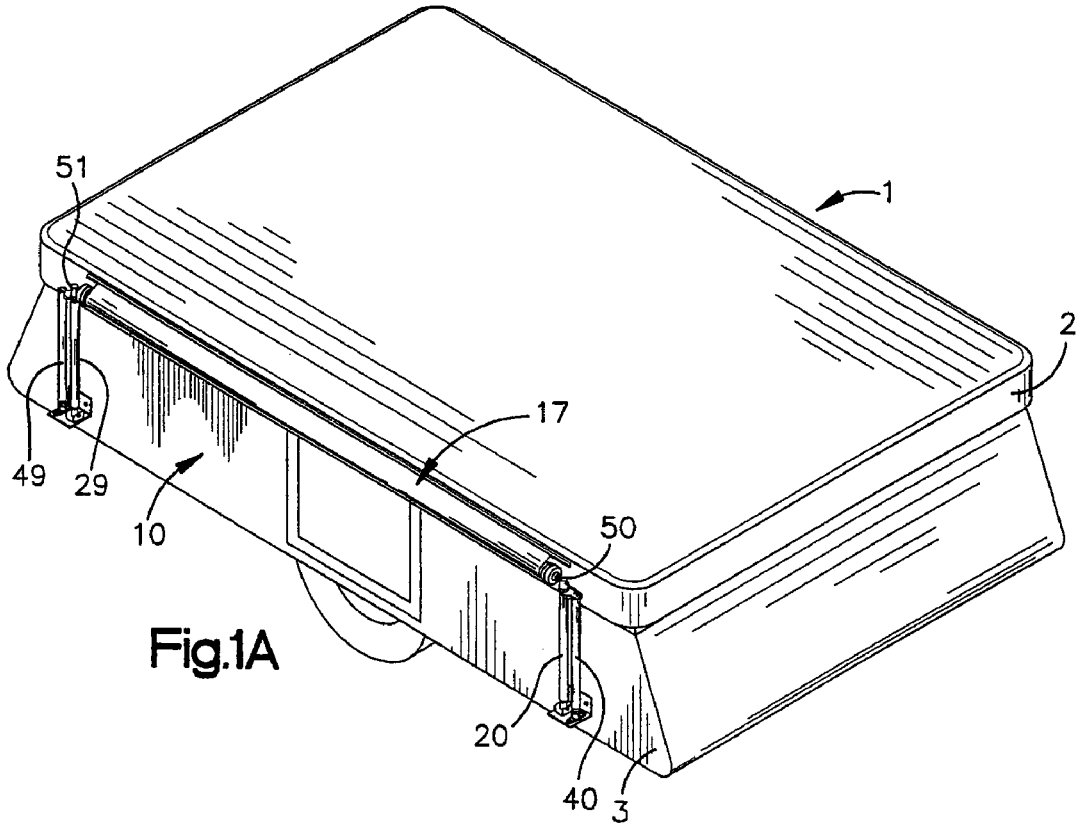
FIG. 1A is a perspective view of the pop-up trailer with the tent-like upper section of the trailer in a lowered position and the awning assembly of the invention mounted to the trailer with the awning shown in a retracted position.

Referring to FIGS. 1 and 1A, there is shown in those figures the awning assembly of the invention, indicated generally at 10, mounted to a pop-up trailer, indicated generally at 1. In FIG. 1A the awning of the awning assembly is shown in a retracted position, and in FIG. 1 the awning is shown in an extended position. The trailer has an upper section 2 and a lower section 3 and, as is well known with tent trailers, the upper section 2 is movable between the lowered, or collapsed, position shown in FIG. 1A and the raised, or deployed, position shown in FIG. 1. The awning, or canopy, 11 of the awning assembly 10 has a forward border 12 having first and second opposed end portions 13 and 14, respectively. The awning also includes a rearward border 15 that is anchored to the upper section 2 of the trailer. A main awning section 16 joins the forward and rearward borders of the awning and the forward border of the awning is extendable from a retracted position adjacent the trailer to an extended position away from the trailer and retractable from the extended position to the retracted position.

The forward border 12 of the awning is attached to a roller mechanism, indicated generally at 17, having two opposed end portions 50 and 51 and a longitudinal axis of rotation extending from one opposed end portion to the other opposed end portion through the center of the roller mechanism as described in greater detail below. As illustrated in FIGS. 1 and 1A, the roller mechanism extends, essentially, along the entire length of the forward border 12 of the awning and provides a means on and from which the awning is wound and unwound, respectively. Of course, the precise configuration of the awning is a matter of choice and it is not required that a roller mechanism be provided for winding and unwinding the awning. Other means for gathering and deploying the awning may be employed. For example, the awning can be fashioned from a pleated fabric in which case the awning will fold on itself when the awning is retracted.

Referring again to FIGS. 1 and 1A, it is there illustrated that the awning is held in place by a pair of support arms 20 and 29 each of which is joined at one end to a respective end portion 50 and 51 of the roller mechanism and at the other end portion is mounted to the lower section of the trailer. The lengths of the support arms are adjustable. Because of the angle at which the trailer and awning assembly are viewed in FIG. 1, only one of the support arms are visible in that figure. The awning is also supported by a pair of rafters 40 and 49, each of which is joined at one end portion to a respective one of the support arms 20 and 29. The other end portion of each rafter 40 and 49 is mounted to the upper section of the trailer when the awning is in an extended position, as shown in FIG. 1, and to the lower section of the trailer when the awning is in a retracted position, as shown in FIG. 1A. The lengths of the rafters are adjustable.

The details of the awning assembly will now be described with particular reference to FIGS. 2 through 8. In those figures, only one end portion of the awning assembly, including the roller mechanism and the support arms and rafters, are illustrated because in the presently preferred embodiment of the invention, the two end portions of the awning assembly are, substantially, identical. However, it is not essential that they be identical and variations in the details of the two end portions of the awning assembly can be made as will be understood by those skilled in the art.

Figure 3:
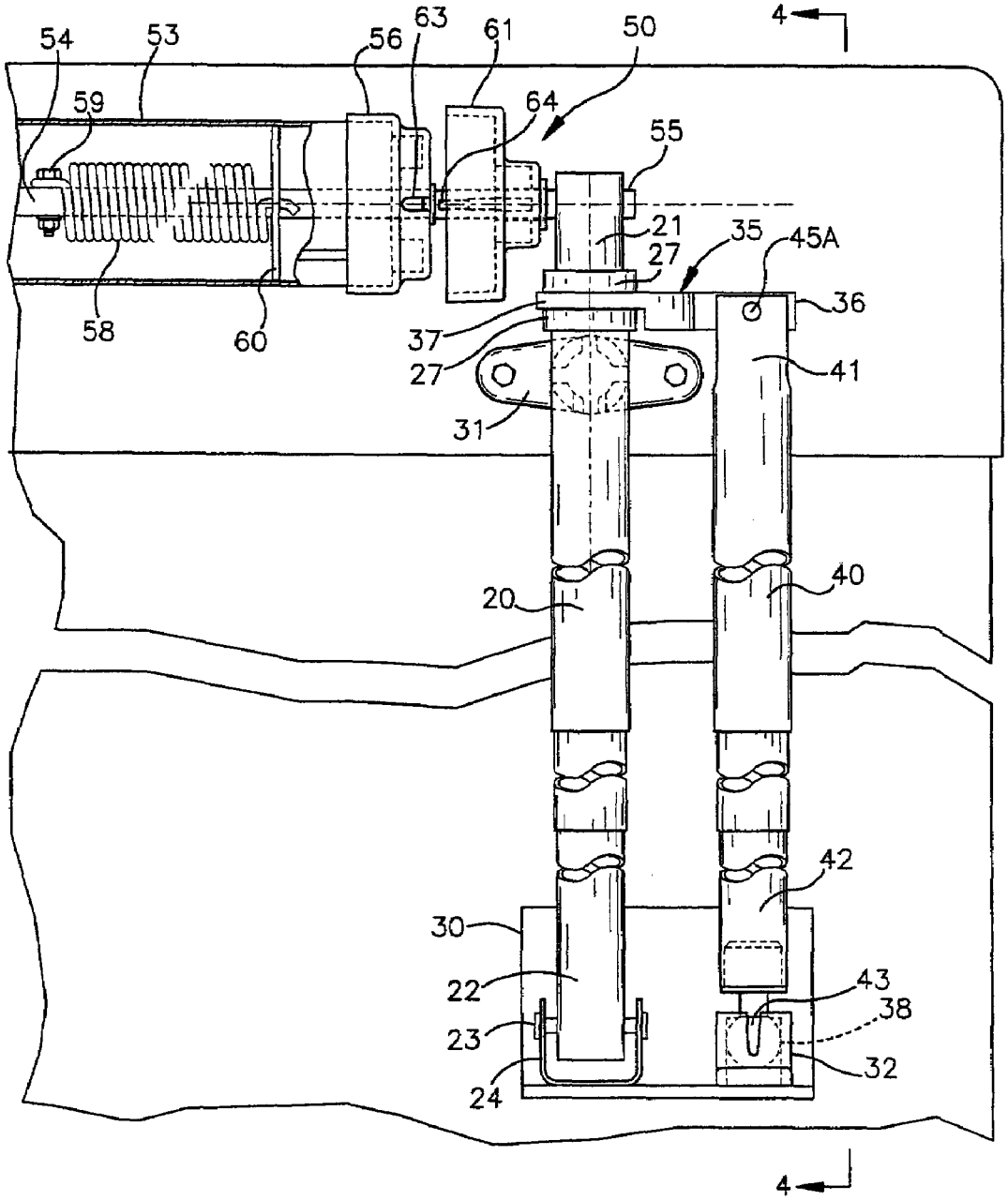
FIG. 3 is a front elevational view, partly in section to illustrate certain of the internal parts of the roller mechanism, of one end of the awning assembly shown mounted to the trailer with the trailer in a lowered position and the awning in a retracted position.
Figure 4:
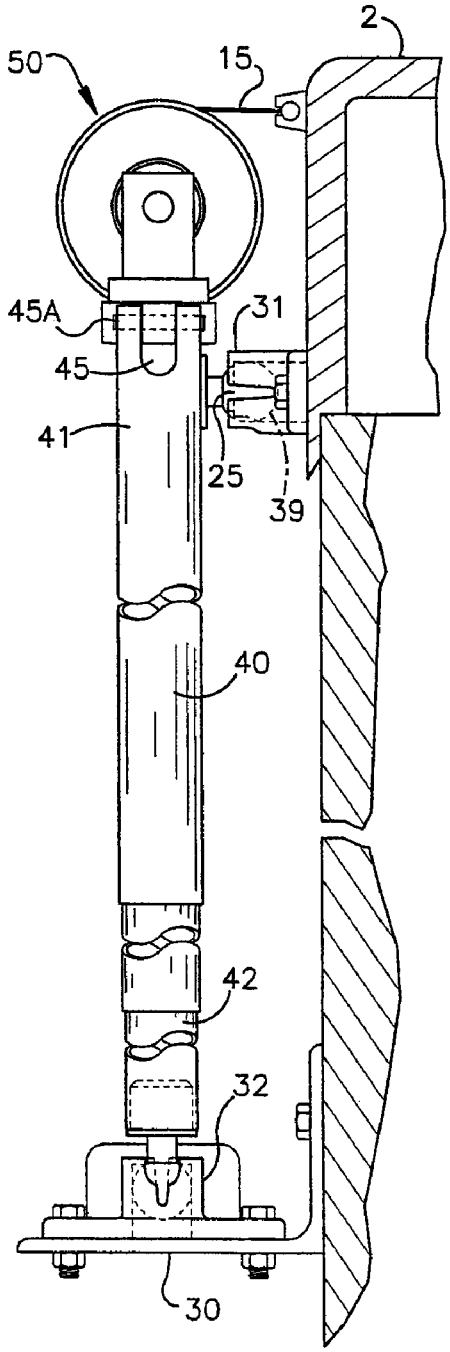
FIG. 4 is an end elevational view of the awning assembly along the section line 4-4 of FIG. 3.
Figure 5:
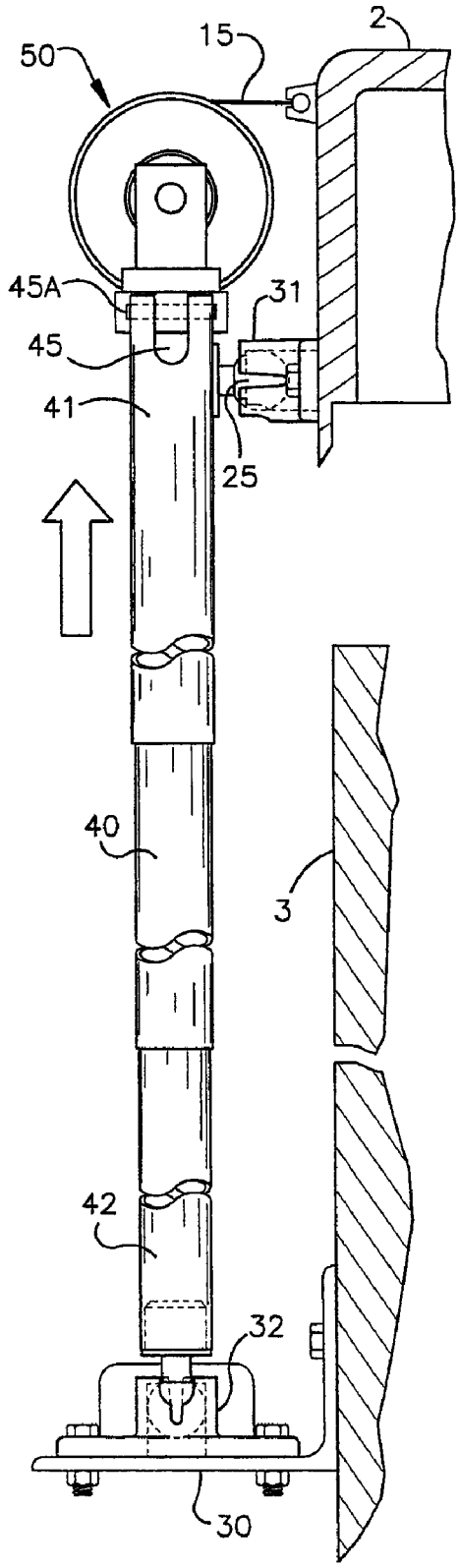
FIG. 5 is an end elevational view of the awning assembly similar to the view of FIG. 4 but with the tent-like upper section of the trailer raised.
Figure 6:
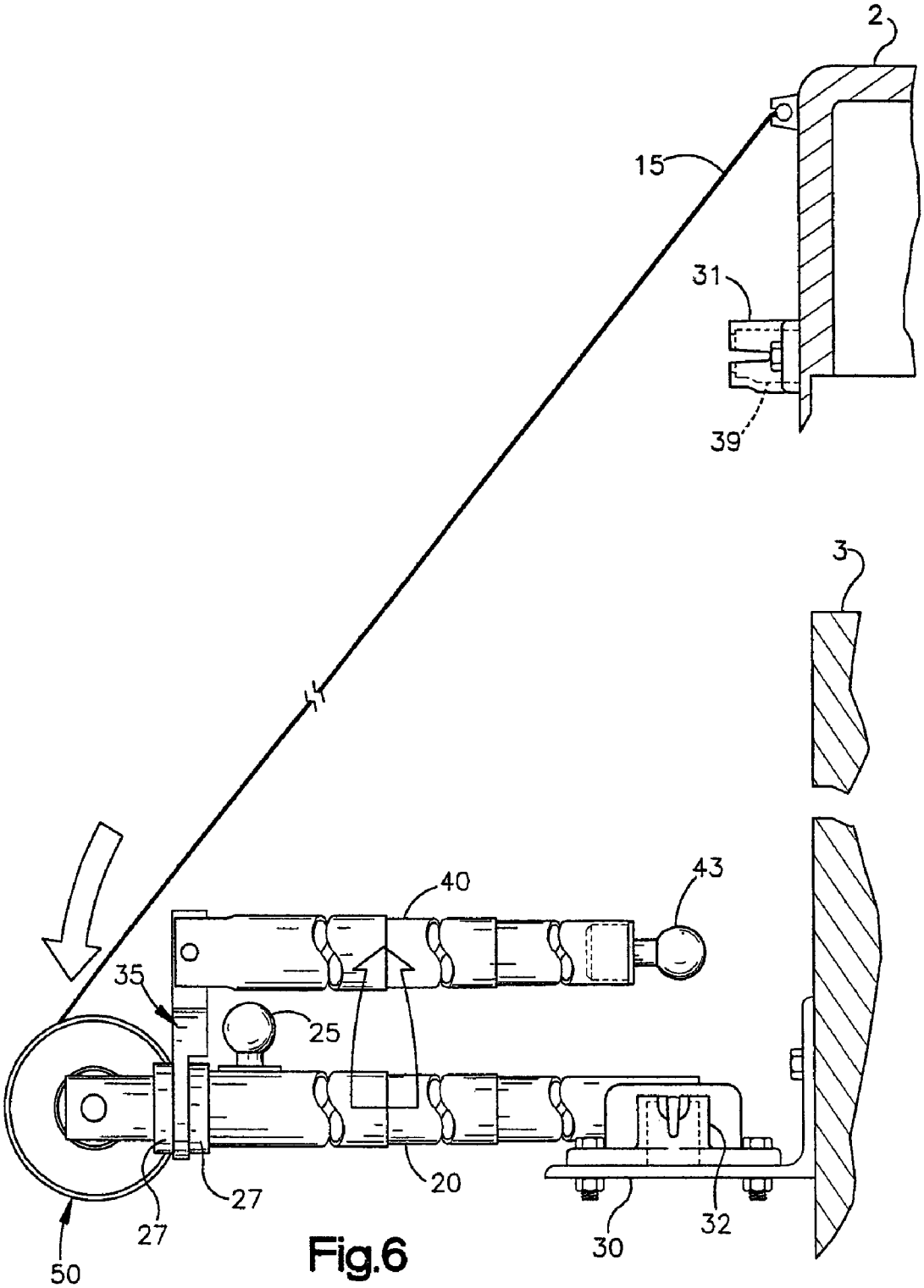
FIG. 6 is an end elevational view of the awning assembly with the supporting arm and rafter and the roller mechanism shown as released from the upper section of the trailer and, together with the awning, in an initial position for deployment of the awning to an extended position.

FIGS. 3, 4 and 5 show the arrangement of the components of the awning assembly when the awning is in a retracted position and the support arms and rafters are held in place, essentially, up against the backing structure of the trailer 1. These figures illustrate the first support arm 20 that has a first opposed end portion 21 and a second opposed end portion 22. As explained in more detail below, the first opposed end portion 21 of the first support arm 20 is joined to the first opposed end portion 13 of the forward border 12 of the awning for concurrent movement when the awning is extended and retracted from the trailer. The second opposed end portion 22 of the first support arm is pivotally connected to the lower section of the trailer by means of a pivot pin 23 that extends axially through the second opposed end portion 22 of the first support arm 20 and is supported in a stirrup 24 fastened to a first mounting plate 30 that is secured to the lower section of the trailer. This connection allows for pivotal movement of the first support arm on the first mounting plate 30 away from the trailer for extension of the awning and toward the structure for retraction of the awning. Fastened to the first opposed end portion 21 of the first support arm is a releasable securing element in the form of spherical ball 25 that releasably secures the first support arm 20 to a first mating element 31 when the awning is in a retracted position. The first mating element 31 is fastened to the upper section of the trailer and includes a spherical socket 39 in which the spherical ball 25 is located when the awning is in a retracted position.

Joined to the first support arm 20 is the first rafter 40 which has a first opposed end portion 41 and a second opposed end portion 42. The first opposed end portion 41 of the first rafter 40 is joined with the first opposed end portion 21 of the first support arm 20 for pivotal movement of the first rafter in relation to the first support arm as further described below. The second opposed end portion 42 of the first rafter 40 has a releasable securing element in the form of a spherical ball 43 that is substantially identical to spherical ball 25 and releasably secures the first rafter 40 to a third mating element 32 when the awning is in a retracted position. The third mating element is secured to the mounting plate 30 on the lower section of the trailer and the third mating element includes a spherical socket 38 in which the spherical ball 43 is releasably located when the awning is in a retracted position. The spherical ball 43 also releasably secures the first rafter to the first mating element 31 when the awning is in an extended position as discussed below with specific reference to FIGS. 2, 7 and 8.

As will be apparent from the description of the invention set forth hereafter, the lengths of the first support arm 20 and the first rafter 40 must be able to be adjusted in order to accommodate the extension and retraction of the awning. Accordingly, the first support arm 20 and the first rafter 40 are made of telescoping members so that the lengths of the first support arm 20 and the first rafter 40 can be adjusted as needed. Means are provided on the first support arm 20 and the first rafter 40 to lock the telescoping members in place when they are in their final positions. By way of example, complementary holes and spring-loaded pins can be provided in the telescoping members whereby a pin in one telescoping member will enter a complementary hole in another telescoping member so as to lock the members together, as is well known in the art. Of course, it is not required that the support arm and rafter be made of telescoping members and other kinds of constructions can be employed in order to provide a support arm and rafter that have the ability to have their lengths adjusted. For example the support arm rafter can be made of foldable units.

As indicated above, the two end portions of the awning assembly in the presently preferred embodiment of the invention are substantially identical. Consequently, it will be understood that the assembly also includes a second support arm that has first and second opposed end portions with the first opposed end portion of the second support arm and the second opposed end portion 14 of the forward border 12 of the awning being joined for concurrent movement when the awning is extended and retracted. Additionally, the second opposed end portion of the second support arm is pivotally connected to the trailer for pivotal movement of the second support arm away from the trailer for extension of the awning and toward the trailer for retraction of the awning. The second support arm has at its first opposed end portion a releasable securing element in the form of a spherical ball that releasably secures the second support arm to a second mating element at the upper section of the trailer when the awning is in a retracted position, the second mating element having a complementary spherical socket in which the spherical ball is located. Further, there is provided a second rafter having first and second opposed end portions, the first opposed end portion of the second rafter being joined with the first opposed end portion of the second support arm for pivotal movement of the second rafter in relation to the second support arm. The second opposed end portion of the second rafter has a releasable securing element in the form of a spherical ball that releasably secures the second rafter to a fourth mating element at the lower section of the trailer when the awning is in a retracted position, the fourth mating element having a complementary spherical socket in which the spherical ball is located. When the awning is extended, the releasable securing element on the second opposed end portion of the second rafter releasably secures the second rafter to the second mating element.

Figure 2A:
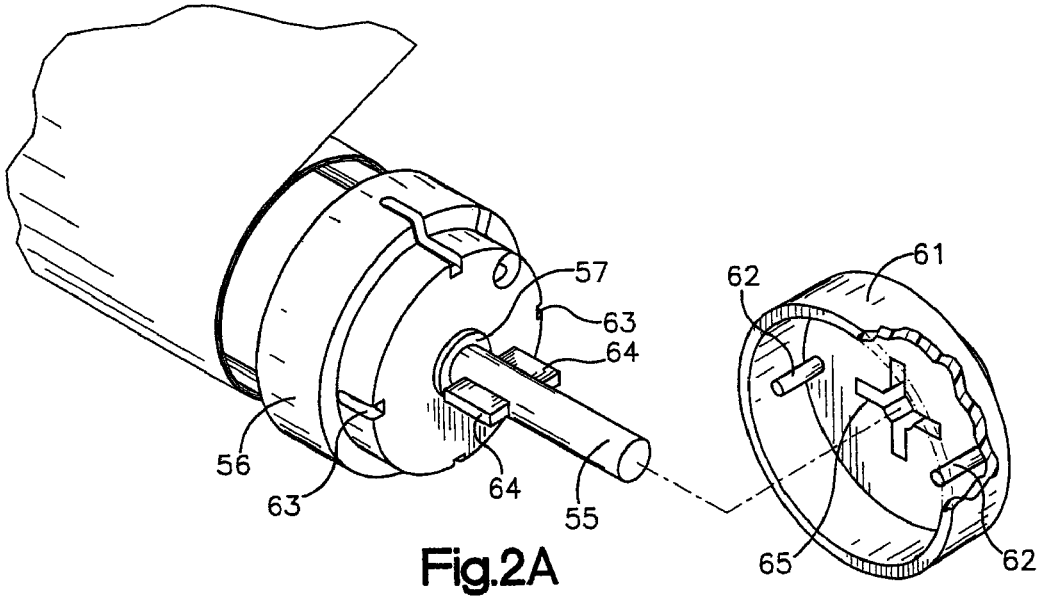
FIG. 2A is an exploded perspective view of one end of a roller mechanism of the awning assembly on and from which the awning is wound and unwound, respectively, and a locking mechanism that prevents the roller mechanism from rotating.
Figure 2:
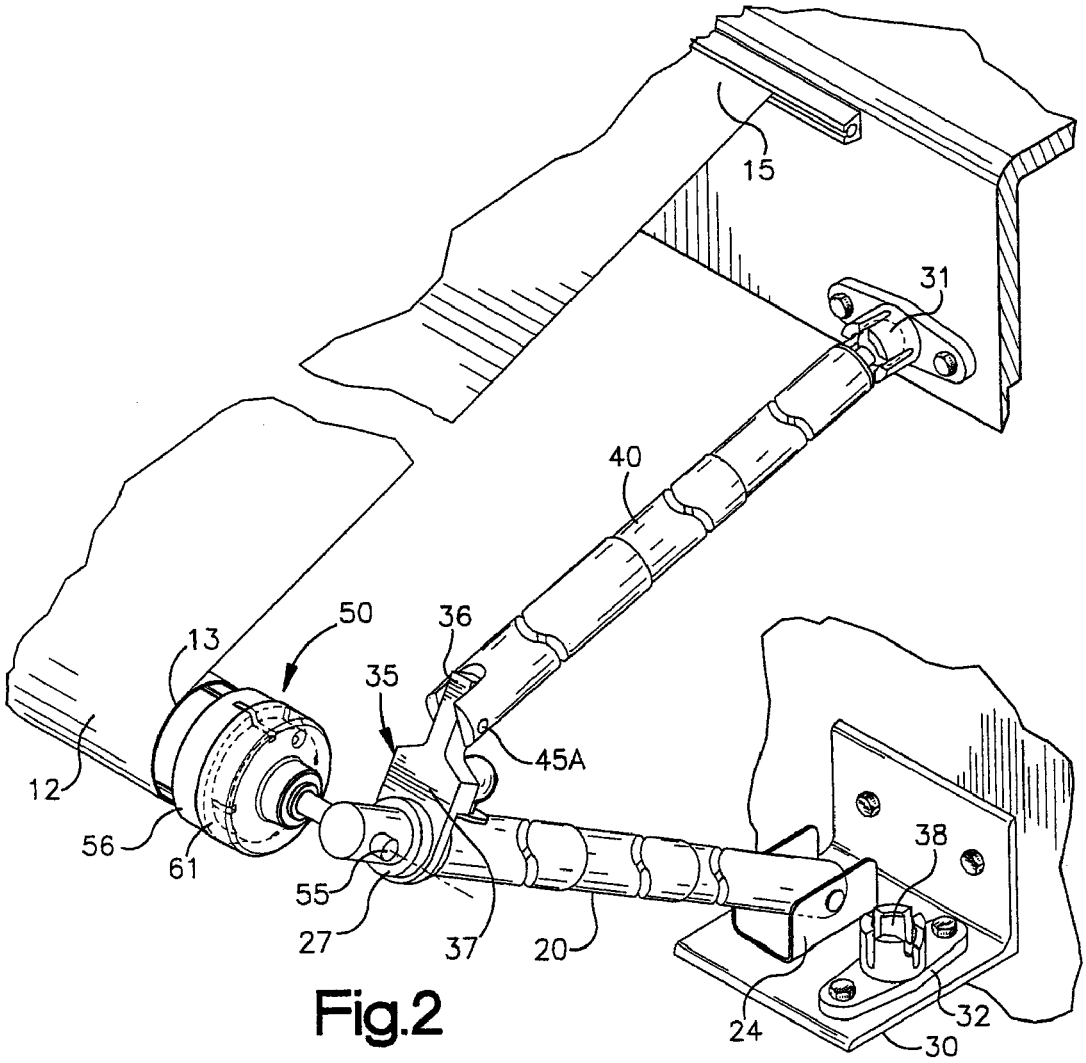
FIG. 2 is a perspective view of one end of the awning assembly with the awning in an extended position.

Referring now to FIGS. 2 and 3, it is there shown that the first opposed end portion 41 of the first rafter 40 is joined with the first opposed end portion 21 of the first support arm 20 by a first bracket indicated generally at 35. The first bracket comprises a plate that has an elongated narrow portion 36 and a broad portion 37. The first opposed end portion 41 of the first rafter 40 includes a notch 45 in which elongated portion 36 of the bracket 35 is pivotally mounted to the first rafter by means of pivot pin 45A so as to pivotally join the first opposed end portion 41 of the first rafter 40 to the first bracket 35 and, thereby, to the first opposed end portion 21 of the first support arm 20. An opening is provided in the broad portion 36 of bracket 35, and the first opposed end portion 21 of the first support arm 20 is inserted through the opening. The bracket 35 is maintained in place on the first opposed end portion 21 of the first support arm by a pair of collars 27 that are fastened to the first opposed end portion 21 of the first support arm 20 on either side of the broad portion 37 of the bracket 35. The opening in the broad portion 37 of the bracket 35 is somewhat larger than the diameter of the first opposed end portion 21 of the first support arm 20 so that the first bracket is rotatably secured to the first support arm. As a result, the first opposed end portion 41 of the first rafter 40 is joined with the first opposed end portion 21 of the second support arm 20 for rotational movement of the first rafter about the first support arm 20, particularly, in connection with the securing of the second opposed end portion 42 of the first rafter 40 to the first mating element 31 as is further described below.

Again, it will be understood that because the opposed end portions of the awning assembly are substantially identical a second bracket is provided and the first opposed end portion of the second rafter is joined with the first opposed end portion of the second support arm by the second bracket. The second bracket is substantially identical with the first bracket and is pivotally joined to the first opposed end portion of the second rafter and rotatably secured to the first opposed end portion of the second support arm. Consequently, the second rafter may be rotated about the second support arm in connection with the securing of the second opposed end portion of the first rafter to a second mating element on the upper section of the trailer.

Referring now to FIGS. 2, 2A and 3, there is best shown in these figures the arrangement of the roller mechanism 17 of the awning assembly about which a flexible material such as an awning may be wound and unwound. The roller mechanism includes a locking mechanism, for locking the roller mechanism in place. In general, the roller mechanism has two opposed end portions 50 and 51 and a longitudinal axis of rotation extending from the one opposed end portion to the other opposed end portion through the center of the roller mechanism. The roller mechanism extends, essentially, along the entire length of and is attached to the forward border 12 of the awning 11. The roller mechanism is mounted at its opposed end portions from the first opposed end portion 21 of the first support arm 20 and from the first opposed end portion of the second support arm, respectively, for rotation about it longitudinal axis, whereby the awning is unwound from and wound on the roller as the awning is extended and retracted, respectively.

Specifically, the roller mechanism includes a roller tube 53 that has two opposed end portions that, generally, coincide with the respective opposed end portions 50 and 51 of the roller mechanism and a longitudinal axis of rotation extending from one opposed end portion to the other opposed end portion through the center of the roller tube. The roller tube is mounted for rotation in both a clockwise and counterclockwise direction about the longitudinal axis of rotation and is adapted to be attached to one end of the flexible awning. Specifically, the forward border 12 of the awning is attached to the roller tube 53 and the awning is unwound from and wound on the roller tube as the awning is extended and retracted, respectively. Various techniques for attaching the awning to the roller mechanism may be employed as are know to those of ordinary skill in the art. By way of example, a circular groove can be provided in the roller mechanism along its length and the awning can be attached to the roller mechanism by placing the forward border of the awning in the groove and holding it in place by means of an elongated dowel that is inserted into the circular groove.

A rod 54 extends along the longitudinal axis of rotation of the roller tube 53. The rod has two opposed end portions that extend beyond the respective end portions of the roller tube 53, and the opposed end portions of the rod are fixed to respective first opposed end portions of the first support arm and the second support arm. Because only one end portion of the awning assembly is shown in the figures, only opposed end portion 55 of the rod 54, as fixed to the first opposed end portion 21 of the first support arm 20, is depicted, it being understood that a similar arrangement exists between the other opposed end portion of the rod 54 and the second support arm. Each of the opposed end portions of the roller tube includes a respective closure cap that is fixed to the end portion of the roller tube. In FIGS. 2A and 3, the closure cap is shown at 56 and includes an opening 57 through which rod 54 extends. The opening 57 is slightly larger than the diameter of the rod 54 so that the roller tube is supported for rotational motion clockwise and counterclockwise on the rod about the longitudinal rotational axis of the roller tube. The cap 56 is made of plastic and, consequently, the roller will readily rotate on the rod 54. If desired, a bearing arrangement can be provided within the opening 57 between the rod 54 and the cap 56.

The roller mechanism also includes a resilient member in the form of torsion spring 58 through which rod 54 extends. The torsion spring is attached at one end to the rod 54 by means of the bolt and nut 59. The other end of the torsion spring is attached to disk-like member 60 that is integral with the interior surface of the roller tube. The torsion spring is mounted to the rod 54 and member 60 so that it is in a neutral condition, i.e., no tension is applied to the spring, when the awning is in a retracted position Consequently, it will be understood that the torsion spring will resist the rotation of the roller tube in a direction for unwinding of the awning from the roller tube, and the extension of the awning from the retracted position to the extended position, and assist the rotation of the roller tube in a direction for winding of the awning on the roller tube, and the retraction of the awning from the extended position to the retracted position.

In order to lock the roller mechanism in place, particularly when the awning is extended and the stored energy in the tension spring is causing the roller to rotate so as to retract the awning, the roller mechanism includes a locking mechanism.

The locking mechanism includes a locking device 61 that is mounted adjacent an opposed end portion of the roller tube 53. The locking device is mounted for selective movement axially of the longitudinal axis of rotation of the roller tube toward and away from the opposed end portion of the roller. In the embodiment shown in the figures, the locking device 61 is slidably mounted on rod 54. The locking device includes at least one locking pin 62 and the opposed end portion of the roller tube 53 includes at least one complementary longitudinal slot 63 extending substantially parallel to the longitudinal axis of rotation of the roller tube. In the embodiment of the invention shown in the figures a pair of diametrically opposed locking pins 62 are provided in the locking device and a complementary pair of longitudinal slots 63 are proved in cap 56. As a result, when the locking device is moved into engagement with the opposed end portion of the roller tube, the locking pins 62 on the locking device are inserted into the longitudinal slots 63 of cap 56. Conversely, when the locking device is moved out of engagement with the opposed end portion of the roller tube, the locking pins 62 are removed from the longitudinal slots 63 in the cap 56.

To complete the locking mechanism, diametrically opposed lugs 64 are provided that are integral with rod 54. A cruciform slot arrangement 65 is provided about the opening in the locking device 61 through which the first opposed end portion 55 of rod 54 extends. The locking device 56, when it is moved axially on opposed end portion 55 of rod 54 into engagement with the opposed end portion of the roller tube 53, will slide over the lugs 64 and be locked to the rod 54. It will, thus, be understood that because the locking device is locked to rod 54, which is mounted at each of its opposed ends to the respective first opposed end portions of the first and second support arms for nonrotational movement about the longitudinal axis of rotation of the roller tube 53, and the locking pins 62 of the locking device are positioned within the slots 63 of the roller tube cap, the roller tube 53 will be locked to the rod 54 and rotation of the roller tube will be prevented. Although not required, in the presently preferred embodiment of the invention, a locking mechanism as described is provided at the second opposed end portion of the roller mechanism 17.

With the foregoing description of the invention in mind, reference is now made to the drawings, particularly FIGS. 4 through 8, for an explanation of the manner in which the awning assembly is operated for the purpose of deploying the awning from a retracted position to an extended position in connection with the raising of the tent trailer.

FIGS. 3 and 4 illustrate the awning assembly when the tent trailer is in a collapsed condition and the awning assembly has been put away on the trailer such as would be the case, for example, when the trailer is being transported over the highway. At that time, the first opposed end portion of each of the support arm 20 and the rafter 40 are releasably secured to the upper section 2 of the trailer in a, substantially upright, or vertical, position by the engagement of the spherical ball 25, on the support arm 20, with the spherical socket 39 in the first mating element 31. At the same time, the second opposed end portion 22 of the support arm 20 is pivotally secured to the lower section of the trailer by means of the cooperation of the mounting plate 30, which is secured to the lower section of the trailer, the pivot pin 23 and the stirrup 24. Additionally, the second opposed end portion 42 of the rafter 40 is releasably secured to the lower section 3 of the trailer by means of the cooperation of the mounting plate 30, the spherical ball 43 on the second opposed end portion 42 of the rafter 40 and the spherical socket 38 in the mounting element 32. Further, the awning assembly is held in place by the rearward border 15 of awning 11 being anchored to the upper section 2 of the trailer with the forward border 12 of the awning being attached to the roller tube of the roller assembly. In this connection, it will be understood that, preferably, the locking device 61 will be in engagement with the end cap 56 and the locking pins 62 will be inserted in slots 63 whereby any tendency for the roller mechanism to move away from the trailer will be resisted.

FIG. 5 illustrates the condition of the awning assembly at such time as the upper section 2 of the trailer has been raised. The arrangement of parts of the awning assembly in that case is, essentially, the same as when the upper section of the trailer is collapsed except, importantly, with respect to the support arm 20 and the rafter 40. Because the support arm and the rafter are made of telescoping members and are, therefore, adjustable in length, they will be extended as the upper section of the trailer is raised so as to accommodate the increased spacing between the upper and lower sections of the trailer when the upper section has been raised.

After the upper section 2 of the trailer has been raised and it is desired to deploy the awning, the initial steps in the procedure comprise, first, releasing the locking device 61 from the end cap 56 of the lever by sliding it outwardly along rod end 55, second, freeing the support arm 20 and the rafter 40 from the upper section of the trailer by withdrawing spherical ball 25 from socket 39 and, third, pulling the roller mechanism away from the upper section of the trailer to extend the awning against the resisting force of the torsion rod. As the roller mechanism is pulled away from the trailer, the support arm 20 will pivot in saddle 24 and, as that occurs, the spherical ball 43 at the end 42 of the rafter 40 is freed from socket 38 . The roller mechanism is continued to be pulled away from the trailer until the support arm and rafter are in a, substantially, horizontal position. At that point, the rafter 40 is rotated approximately 90 degrees about and upwardly of the support arm 20 by means of bracket 35 and the awning assembly will be in the condition illustrated in FIG. 6. The wider arrow in FIG. 6 indicates that the rafter 40 has been rotated to the position described, and the narrower arrow indicates that the awning has been extended.

Figure 7:
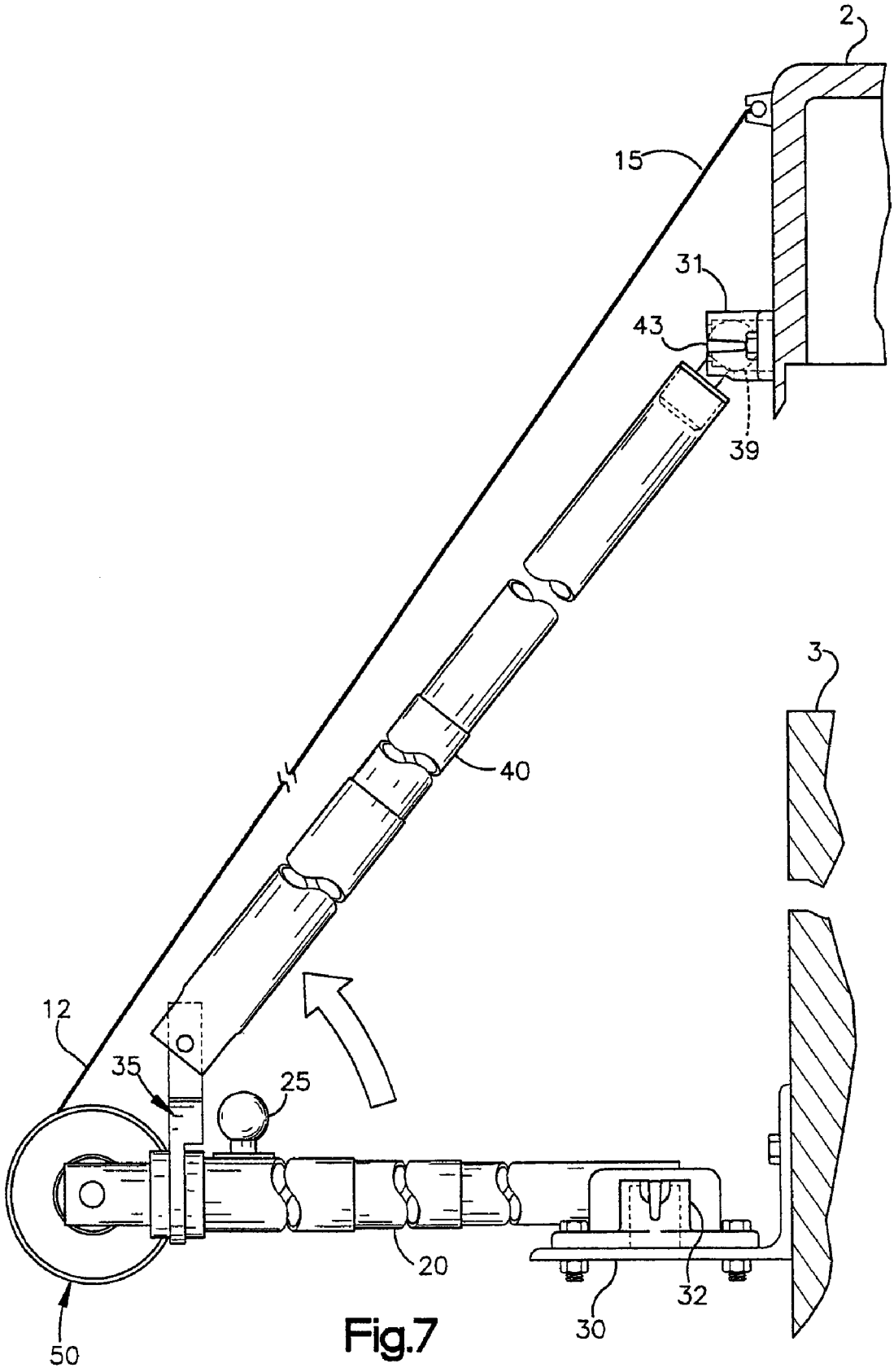
FIG. 7 is an end elevational view of the awning assembly shown with one end of the rafter releasably secured to the upper section of the trailer in an intermediate position for deployment of the awning to an extended position.

The next step in the deployment of the awning is shown in FIG. 7. As illustrated in that figure, the rafter 40 is raised and the spherical ball 43 at the second opposed end portion 42 of the rafter 40 is inserted into the spherical socket 39 in the first mating element 31 that is secured to the upper section of the trailer. This raising of the rafter is indicated by the arrow in FIG. 7.

Figure 8:
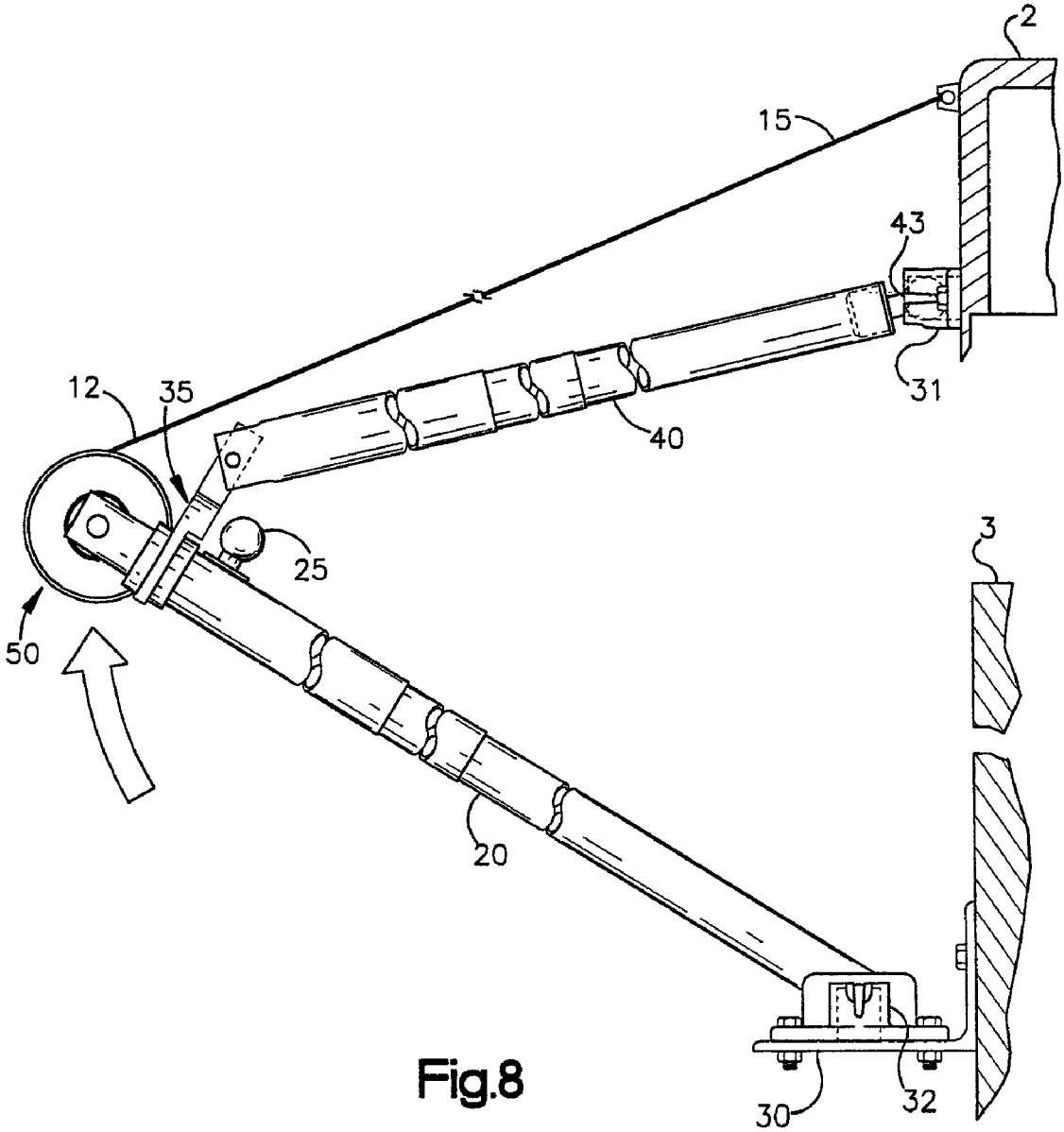
FIG. 8 is an end elevational view of the awning assembly shown with the awning in a final extended position.

Finally, as shown in FIG. 8, the roller mechanism 17 is raised to the desired position as indicated by the arrow in FIG. 8. It will be understood that as the awning assembly is deployed as has been described, the lengths of the support arms and the rafters will vary and this variation in lengths is accommodated by the telescoping units that make up the support arms and the rafters. At such time as the awning is in a desired position, however, the telescoping members of the support arms are locked in place and the rafters can be raised slightly further until the desired tension in the awning is achieved at which time the telescoping members of the rafters are locked into place. At that point, the locking device 61 is returned into engagement with the end cap 56 and locking pins 62 inserted into slots 63.

The foregoing description of the deployment of the awning assembly of the invention has been presented with reference to only one end portion of the awning assembly, However, it will be understood that a similar operation is conducted at the other end portion of the awning assembly for the purpose of deploying the awning.

While a presently preferred embodiment of the invention has been shown and described herein, it is to be understood that the invention is not so limited but covers and includes any and all modifications and variations that are encompassed by the following claims.

What is claimed is:

1. An awning assembly for mounting to a structure including:

a first member including a first proximal end and a first distal end, the first proximal end movably joined to a structure;

a second member including a second proximal end and a second distal end, the second proximal end movably joined to a structure; and a roller mechanism about which a flexible material may be wound and unwound comprising;

a roller tube having two opposed end portions and a longitudinal axis of rotation extending from one opposed end portion of the roller tube to the other opposed end portion through the center of the roller tube, the roller tube being mounted for rotation in both a clockwise and a counterclockwise direction about the longitudinal axis of rotation and being adapted to be attached to one end of the flexible material, at least one opposed end portion of the roller tube having at least one longitudinal slot extending substantially parallel to the longitudinal axis of rotation of the roller tube; and a locking device mounted adjacent the at least one opposed end portion of the roller tube having at least one longitudinal slot, the locking device being mounted for selective movement axially of the longitudinal axis of rotation of the roller tube toward and away from the at least one opposed end portion of the roller tube having at least one longitudinal slot and for selective nonrotational movement about the longitudinal axis of rotation of the roller tube, the locking device including locking pins for insertion into respective ones of the at least one longitudinal slot in the roller tube when the locking device is moved into engagement with the at least one opposed end portion of the roller tube having at least one longitudinal slot and for removal from the at least one longitudinal slot when the locking device is moved out of engagement with the at least one opposed end portion of the roller tube having at least one longitudinal slot, wherein the longitudinal axis of rotation passes through the first distal end and the second distal end and wherein the longitudinal axis of rotation undergoes substantially translational movement as the flexible material is wound and unwound.

2. The awning assembly of claim 1 including a rod extending along the longitudinal axis of rotation of the roller tube, the rod being secured against rotational movement, and a resilient element being connected to the rod and the roller tube so as to resist rotation of the roller tube about the longitudinal axis of rotation in relation to the rod.

3. The awning assembly of claim 2 wherein the rod extends outwardly of at least the at least one opposed end portion of the roller tube that has at least one longitudinal slot and the locking device is mounted on the rod for selective movement axially toward and away from the at least one opposed end portion of the roller tube having at least one longitudinal slot and for selective non-rotational movement with respect to the rod.

4. The awning assembly of claim 3 wherein the at least one opposed end portion of the roller tube having at least one longitudinal slot includes a closure cap through which the rod extends outwardly of the roller tube and by means of which the roller tube is rotatably mounted on the rod, and the at least one longitudinal slot is located in the closure cap.

5. The awning assembly of claim 4 wherein the resilient element comprises a torsion spring through which the rod extends.

6. The awning assembly of claim 5 wherein the at least one closure cap includes two diametrically opposed longitudinal slots and a respective locking device includes two locking pins that are positioned on the locking device so that they may be inserted into the two diametrically opposed slots in the closure cap when the locking device is moved into engagement with the roller tube.

7. The awning assembly of claim 1 wherein each opposed end portion of the roller tube has at least one longitudinal slot extending substantially parallel to the longitudinal axis of rotation of the roller tube and a respective locking device is mounted adjacent each of the opposed end portions of the roller tube.

8. The awning assembly of claim 7 including a rod extending along the longitudinal axis of rotation of the roller tube, the rod being secured against rotational movement, and a resilient element being connected to the rod and the roller tube so as to resist rotation of the roller tube about the longitudinal axis of rotation in relation to the rod.

9. The awning assembly of claim 8 wherein the rod extends outwardly of both opposed end portions of the roller tube and each locking device is mounted on a respective one of the end portions of the rod for selective movement axially toward and away from a respective one of the opposed end portions of the roller tube and for selective nonrotational movement with respect to the rod.

10. The awning assembly of claim 9 wherein each of the opposed end portions of the roller tube includes a closure cap through which the rod extends outwardly of the roller tube and by means of which the roller tube is rotatably mounted on the rod, and the at least one longitudinal slot in each opposed end portion of the roller tube is located in a respective closure cap.

11. The awning assembly of claim 10 wherein each closure cap includes two diametrically opposed longitudinal slots and each locking device includes two locking pins that are positioned on the locking device so that they may be inserted into the two diametrically opposed slots in a respective closure cap when the locking device is moved into engagement with a respective opposed end portion of the roller tube.

12. The awning assembly of claim 11 wherein the resilient element comprises a torsion spring through which the rod extends.

13. The awning assembly of claim 1, wherein the first and second members include telescoping members supporting the roller mechanism.

14. The awning assembly of claim 13, wherein the roller mechanism is configured to form a forward border of an awning.

15. The awning assembly of claim 6, wherein the at least one closure cap includes a first set of two diametrically opposed longitudinal slots and a second set of two diametrically opposed longitudinal slots substantially perpendicular to the first set, the rod includes diametrically opposed lugs, the locking device includes a cruciform slot such that axial movement of the locking device toward and away from the opposed end portions of the roller tube slides the locking device over the opposed lugs.

* * * * *

UNITED STATES PATENT AND TRADEMARK OFFICE

CERTIFICATE OF CORRECTION

PATENT NO. : 7,556,079 B2
APPLICATION NO. : 11/759412
DATED : July 7, 2009
INVENTOR(S) : Michael Hicks and Brandon Moore It is certified that error appears in the above-identified patent and that said Letters Patent is hereby corrected as shown below:

On the Cover Page:

Item 57, Abstract, Line 12: Please delete "awning assembly" and replace with --roller mechanism--

Signed and Sealed this

Twenty-ninth Day of September, 2009

David J. Kappos

David J. Kappos
*Director of the United States Patent and Trademark Office*